US007197253B2

(12) United States Patent
Oyama et al.

(10) Patent No.: US 7,197,253 B2
(45) Date of Patent: Mar. 27, 2007

(54) IMAGE FORMING APPARATUS INCLUDING TWO CPUS TO CONTROL A FIXING DEVICE

(75) Inventors: Hiroshi Oyama, Hino (JP); Masashi Sugano, Toyokawa (JP); Tadashi Matsudaira, Hachioji (JP); Katsunori Takahashi, Hachioji (JP); Masayuki Watanabe, Fuchu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 121 days.

(21) Appl. No.: 10/931,895

(22) Filed: Sep. 1, 2004

(65) Prior Publication Data

US 2006/0045550 A1 Mar. 2, 2006

(51) Int. Cl.
*G03G 15/20* (2006.01)

(52) U.S. Cl. ..... 399/33

(58) Field of Classification Search ..... None
See application file for complete search history.

(56) References Cited

U.S. PATENT DOCUMENTS 4,804,974 A * 2/1989 Sugata et al. ..... 347/204
6,321,046 B1 * 11/2001 Kikuchi et al. ..... 399/69
2005/0047810 A1 * 3/2005 Nagatsuma et al. ..... 399/69

FOREIGN PATENT DOCUMENTS

JP 05210335 A * 8/1993
JP 05307340 A * 11/1993
JP 09114311 A * 5/1997
JP 09311608 A * 12/1997
JP 2001125427 A * 5/2001
JP 2002278409 A * 9/2002
JP 2003255758 A * 9/2003

* cited by examiner

*Primary Examiner*—Quana Grainger
(74) *Attorney, Agent, or Firm*—Prishauf, Holtz, Goodman & Chick, P.C.

(57) ABSTRACT

An image forming apparatus, is provided with a fixing device including a heat source to receive power supply and to generate heat, and a temperature sensor to detect a temperature of the heat source; a control section to conduct a heat source temperature control and an abnormal temperature detecting control in response to a detection result of the temperature sensor; and an electric power cutout section to cut out the power supply to the heat source on a basis of the abnormal temperature detecting control by the control section. The control section conducts the heat source temperature control for the fixing device and/or the abnormal temperature detecting control for the electric power cutout section with at least two CPUs.

10 Claims, 2 Drawing Sheets

| A | B | X | HEATER | |
|---|---|---|---|---|
| 1 | 1 | 1 | OFF | ← (1) |
| 1 | 0 | 0 | ON | |
| 0 | 1 | 0 | ON | |
| 0 | 0 | 0 | ON | |

| C | D | Y | RELAY | |
|---|---|---|---|---|
| 1 | 1 | 1 | ON | ← (2) |
| 1 | 0 | 0 | OFF | |
| 0 | 1 | 0 | OFF | |
| 0 | 0 | 0 | OFF | |

IMAGE FORMING APPARATUS INCLUDING TWO CPUS TO CONTROL A FIXING DEVICE

BACKGROUND OF THE INVENTION

The present invention relates to an image forming apparatus that appropriately controls the heater that is used as the heat source employed for fixing during image formation.

In general, in an image forming apparatus based on the xerographic method, in order to carry out thermal fixing of the toner image that has been transferred on to the entire surface of the image supporting body such as-transfer paper on to said image supporting body, very often a fixing apparatus is used that consists of a fixing heated roller in contact with the surface of said image supporting body and a pressure roller that is placed so as to be pressed against this fixing heated roller.

Further, in this type of fixing apparatus, as a heating source of the fixing heated roller, a heater such as a halogen lamp is provided inside the roller as its heat source.

In addition, a temperature sensor is provided for this heat source, and the result of detection by the temperature sensor is supplied to the single CPU used as a controlling means. Further, the single CPU will be carrying out "heat source temperature control" and "temperature abnormality detection control".

Here, "heat source temperature control" is carrying out the control of the temperature of the heat source so that it is maintained near the set temperature by repeatedly switching on and off the power supplied to the heat source. On the other hand, the "temperature abnormality detection control" is carrying out the control of shutting off the power supply to the heat source when the temperature of the heat source goes outside a set range relative to the set temperature thereby judging that said heat source temperature control is not being carried out normally.

Further, in the temperature abnormality detection control described above, it is necessary to immediately shut off the power supply to the heat source. Therefore, if the heat source temperature control and the temperature abnormality detection control are being carried out by a single CPU, some situations may arise when it is not possible to carry out control in a normal manner of the temperature abnormality detection control.

Therefore, as a safety measure when the control could not be carried out normally, the conventional image forming apparatuses were very often provided with a separate hardware circuit that could execute the temperature abnormality detection control (temperature abnormality detection and shutting off the power supply to the heat source) without depending on semiconductors such as the CPU, etc.

By providing separately such a hardware circuit, although the reliability of temperature control of the image fixing apparatus could be maintained, there were problems created such as cost increase and more complex configuration of the image forming apparatus.

In addition, as another problem, if the different types of controls related to the entire image forming apparatus and the temperature control of the heat source are executed by a single CPU, the work load on the CPU becomes large at the time of switching on the power to the apparatus due to the tasks of initializing various sections of the apparatus thereby causing considerable time to be taken until the power supply to the heat source is started, thus causing the problem of requiring long warm-up time of the image fixing apparatus.

The present invention aims to solve problems such as the above, and the purpose of the present invention is to realize an image forming apparatus in which it is possible to carry out control of the temperature of the heat source appropriately without having to use a dedicated hardware circuit for shutting off the power supply when a temperature abnormality occurs in the heat source.

SUMMARY OF THE INVENTION

Further, the present invention was made in order to solve problems such as those described above, and the purpose of the present invention is to realize an image forming apparatus in which it is possible to carry out appropriate and fast control of the heat source temperature even at the time of starting up the image forming apparatus.

The above object can be attained by the following structures.

(A) An image forming apparatus, comprises:

a fixing device including a heat source to receive power supply and to generate heat, and a temperature sensor to detect a temperature of the heat source;

a control section to conduct a heat source temperature control and an abnormal temperature detecting control in response to a detection result of the temperature sensor; and an electric power cutout section to cut out the power supply to the heat source on a basis of the abnormal temperature detecting control by the control section;

the control section conducting the heat source temperature control for the fixing device with at least two CPUs or the abnormal temperature detecting control with at least two CPUs.

(B) An image forming apparatus, comprises:

a fixing device including a heat source to receive power supply and to generate heat, and a temperature sensor to detect a temperature of the heat source; and a control section including at least two CPUs and to conduct a heat source temperature control and an abnormal temperature detecting control for the fixing device with the at least two CPUs in response to a detection result of the temperature sensor.

(C) An image forming apparatus, comprises:

a fixing device including a heat source to receive power supply and to generate heat, and a temperature sensor to detect a temperature of the heat source;

a control section including at least two CPUs and to conduct a heat source temperature control and an abnormal temperature detecting control for the fixing device with the at least two CPUs in response to a detection result of the temperature sensor; and an electric power cutout section to cut out the power supply to the heat source on a basis of the abnormal temperature detecting control by the control section.

Further, the structures that solves the above problems are described below.

(1) The structure described here is an image forming apparatus having the feature that it comprises a fixing unit including a heat source that generates heat upon receiving electric power supply and a temperature sensor that detects the temperature of said heat source, a control means that receives the result of detection by said temperature sensor and carries out the controls of heat source temperature control and temperature abnormality detection control, and a power shut off means (power cutout section) that shuts off the power supply to said heat source based on the temperature abnormality detection control carried out by said control means, and said control means carries out using two or more CPUs (at least two CPUs) the heat source temperature control of a single fixing unit or the temperature abnormality detection control using a single power supply shut off means.

In the present invention, when the control means receives the detection result from the temperature sensor and carries out the heat source temperature control and the temperature abnormality detection control, the control means carries out using two or more CPUs the heat source temperature control of a single fixing unit or the temperature abnormality detection control using a single power supply shut off means.

As a result, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

(2) The structure described here is an image forming apparatus having the feature that it comprises a fixing unit consisting of a heat source that generates heat upon receiving electric power supply and a temperature sensor that detects the temperature of said heat source, a control means that receives the result of detection by said temperature sensor and carries out the controls of heat source temperature control and temperature abnormality detection control, and a power shut off means that shuts off the power supply to said heat source based on the temperature abnormality detection control carried out by said control means, and said control means carries out using two or more CPUs the heat source temperature control of a single fixing unit or the temperature abnormality detection control using a single power supply shut off means, and priority order is assigned to the heat source temperature control by the two or more CPUs constituting said control means with the CPU having the higher priority in the priority order carrying out the heat source temperature control and the temperature abnormality detection control and the CPU with the lower level of priority carrying out the temperature abnormality detection control, the priority order of temperature abnormality detection control is the same in both the CPU with the higher priority level and in the CPU with the lower priority level, and when there is an abnormality in one CPU, the other CPU becomes effective for the control of said power supply shut off means.

In the present invention, when the control means receives the detection result from the temperature sensor and carries out the heat source temperature control and the temperature abnormality detection control, the control means carries out using two or more CPUs the heat source temperature control of a single fixing unit or the temperature abnormality detection control using a single power supply shut off means, and priority order is assigned to the heat source temperature control by the two or more CPUs constituting said control means with the CPU having the higher priority in the priority order carrying out the heat source temperature control and the temperature abnormality detection control and the CPU with the lower level of priority carrying out the temperature abnormality detection control, the priority order of temperature abnormality detection control is the same in both the CPU with the higher priority level and in the CPU with the lower priority level, and when there is an abnormality in one CPU, the other CPU becomes effective for the control of said power supply shut off means.

As a result, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

(3) The structure described here is an image forming apparatus having the feature that it comprises a fixing unit consisting of a heat source that generates heat upon receiving electric power supply and a temperature sensor that detects the temperature of said heat source, a control means that receives the result of detection by said temperature sensor and carries out the controls of heat source temperature control and temperature abnormality detection control, and a power shut off means that shuts off the power supply to said heat source based on the temperature abnormality detection control carried out by said control means, and said control means carries out using two or more CPUs the heat source temperature control of a single fixing unit or the temperature abnormality detection control using a single power supply shut off means, and priority order is assigned to the heat source temperature control by the two or more CPUs constituting said control means with both the CPU having the higher priority in the priority order and the CPU having the lower priority being able to carry out the heat source temperature control and the temperature abnormality detection control, and at the time the power supply to the apparatus is switched on, the CPU with the lower priority level carries out the heat source temperature control irrespective of the status of the heat source.

In the present invention, when the control means receives the detection result from the temperature sensor and carries out the heat source temperature control and the temperature abnormality detection control, the control means carries out using two or more CPUs the heat source temperature control of a single fixing unit or the temperature abnormality detection control using a single power supply shut off means, and priority order is assigned to the heat source temperature control by the two or more CPUs constituting said control means with both the CPU having the higher priority in the priority order and the CPU having the lower priority being able to carry out the heat source temperature control and the temperature abnormality detection control, and at the time the power supply to the apparatus is switched on, the CPU with the lower priority level carries out the heat source temperature control irrespective of the status of the heat source.

As a result, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it. In addition, since the CPU with the lower level of priority is carrying out the heat source temperature control at the time the power supply to the apparatus is switched on, it is possible to carry out appropriately and quickly the temperature control of the heat source at the time the power supply to the image forming apparatus is switched on, in the case when the different processing tasks of starting the image forming apparatus are being handled by the CPU with the higher level of priority.

(4) The structure described here is an image forming apparatus having the feature that it comprises a fixing unit consisting of a heat source that generates heat upon receiving electric power supply and a temperature sensor that detects the temperature of said heat source, a control means that receives the result of detection by said temperature sensor and carries out the controls of heat source temperature control and temperature abnormality detection control, and a power shut off means that shuts off the power supply to said heat source based on the temperature abnormality detection control carried out by said control means, and said control means carries out using two or more CPUs the heat source temperature control of a single fixing unit or the temperature abnormality detection control using a single power supply shut off means, and priority order is assigned to the heat source temperature control by the two or more CPUs constituting said control means with both the CPU having the higher priority in the priority order and the CPU having the lower priority being able to carry out the heat source temperature control and the temperature abnormality detection control, and during the period of time until a specific interval of time has elapsed after the time the power supply to the apparatus is switched on or until the heat source reaches a specific temperature, whichever is reached earlier, the CPU with the lower priority level carries out the heat source temperature control irrespective of the status of the heat source.

In the present invention, when the control means receives the detection result from the temperature sensor and carries out the heat source temperature control and the temperature abnormality detection control, the control means carries out using two or more CPUs the heat source temperature control of a single fixing unit or the temperature abnormality detection control using a single power supply shut off means, and priority order is assigned to the heat source temperature control by the two or more CPUs constituting said control means with both the CPU having the higher priority in the priority order and the CPU having the lower priority being able to carry out the heat source temperature control and the temperature abnormality detection control, and during the period of time until a specific interval of time has elapsed after the time the power supply to the apparatus is switched on or until the heat source reaches a specific temperature, whichever is reached earlier, the CPU with the lower priority level carries out the heat source temperature control irrespective of the status of the heat source.

As a result, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

In addition, since the CPU with the lower level of priority is carrying out the heat source temperature control at the time the power supply to the apparatus is switched on, it is possible to carry out appropriately and quickly the temperature control of the heat source at the time the power supply to the image forming apparatus is switched on, in the case when the different processing tasks of starting the image forming apparatus are being handled by the CPU with the higher level of priority.

(5) The structure described here is an image forming apparatus having the feature that it comprises a fixing unit consisting of a heat source that generates heat upon receiving electric power supply and a temperature sensor that detects the temperature of said heat source, a control means that receives the result of detection by said temperature sensor and carries out the controls of heat source temperature control and temperature abnormality detection control, and a power shut off means that shuts off the power supply to said heat source based on the temperature abnormality detection control carried out by said control means, and said control means carries out using two or more CPUs the heat source temperature control of a single fixing unit or the temperature abnormality detection control using a single power supply shut off means, and a CPU with the highest level of priority is provided that is capable of resetting said two or more CPUs or of shutting off the power supply to them, and said highest priority level CPU resets or shuts off the power supply to the two or more CPUs when a temperature abnormality is detected.

In the present invention, when the control means receives the detection result from the temperature sensor and carries out the heat source temperature control and the temperature abnormality detection control, the control means carries out using two or more CPUs the heat source temperature control of a single fixing unit or the temperature abnormality detection control using a single power supply shut off means, and a CPU with the highest level of priority is provided that is capable of resetting said two or more CPUs or of shutting off the power supply to them, and said highest priority level CPU resets or shuts off the power supply to the two or more CPUs when a temperature abnormality is detected.

As a result, since not only the task of heat source temperature control is shared by plural CPUs but also since the plural CPUs are being controlled by the highest level CPU, the reliability is increased. Because of this, it is possible to carry out appropriate control of the temperature of the heat source without having to use a dedicated hardware circuit for shutting off the power supply to the heat source when there is a temperature abnormality in it.

(6) The structure described here is an image forming apparatus described in (5) above and having the feature that it comprises a display means that displays the status of the apparatus, and when a temperature abnormality is detected, not only that the highest level CPU either shuts off the power supply to or resets any of said two or more CPUs but also the fact that a temperature abnormality has occurred is displayed on said display means.

As a result of this feature, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it and also it becomes possible for the operator to grasp the occurrence of that state easily.

(7) The structure described here is an image forming apparatus described in any one of (1) to (6) above and having the feature that it comprises two or more CPUs for which orders of priorities have been assigned, and a CPU with the highest level of priority is provided that controls said two or more CPUs, each of said CPUs is connected by communication links, the higher level side CPU monitors at regular intervals of time the lower level CPUs and, when any abnormality occurs in a lower level CPU, the control rights possessed by the lower level CPU that has developed an abnormality are immediately transferred to the higher level CPU.

As a result of this, since the task of heat source temperature control is shared by plural CPUs, the reliability is increased, and since a CPU that has developed some abnormality can be reset or its power supply shut off and also the controls being carried out until then by the CPU that has developed an abnormality are handled by a higher level CPU, it is possible to carry out appropriate control of the temperature of the heat source without having to use a dedicated hardware circuit for shutting off the power supply to the heat source when there is a temperature abnormality in it, and also it becomes possible to recover quickly the CPU that has developed an abnormality.

Incidentally, in this specification, "single fixing device" and "single power supply shut off means" are used. These do not means that the fixing device and the power supply shut off means are provided only one respectively. At least two CPUs are provided for a single fixing device and at least two CPUs are provided for a single power supply shut off means. That is, there is no intention to exclude an embodiment in which the fixing device and the power supply shut off means are provided two or more.

PREFERRED EMBODIMENTS OF THE INVENTION

Figure 1:
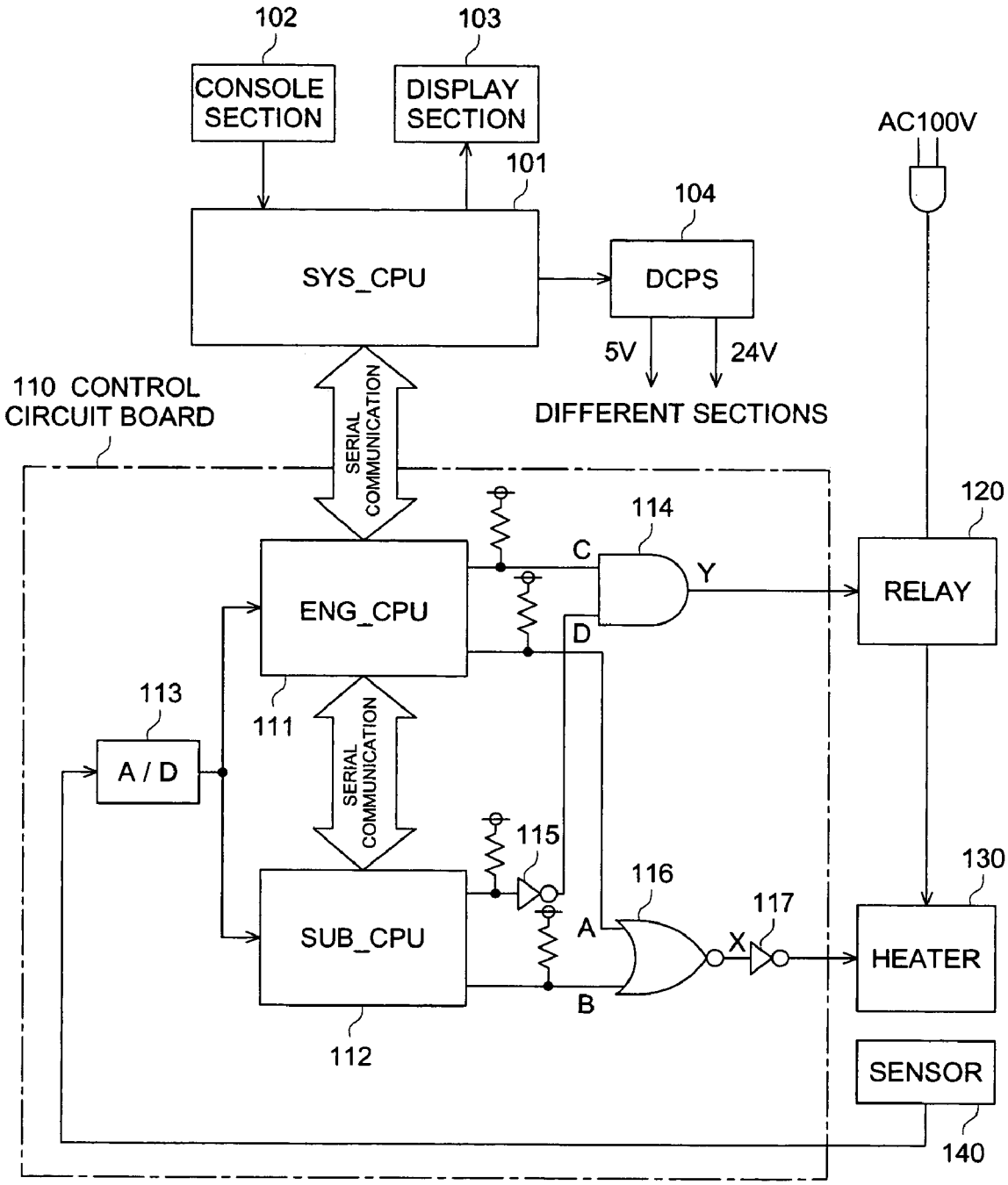
FIG. 1 is a circuit configuration diagram showing an example of the heater switching on circuit in a heater control device according to the first preferred embodiment of the present invention.

A preferred embodiment of the present invention is described in detail below while referring to the drawings. FIG. 1 is a block diagram showing basically the configuration related to heat source control in the image forming apparatus 100.

In this figure, 101 is the SYS_CPU which is the highest level CPU can shut off the power supply or can reset the two or more CPUs to be described later. 102 is the console section using which it is possible to carry out the inputs for the different types of operations on the image forming apparatus, 103 is the display section that displays the various statuses of the image forming apparatus, and 104 is the DC power supply (hereinafter referred to as DCPS) that supplies the DC power (for example, 24V and 5V) to the different sections of the apparatus under the control of SYS_CPU 101.

Further, 110 is the control circuit board containing the two or more CPUs that constitute the control means that carries out the heat source temperature control of a single fixing unit or the temperature abnormality detection control using a single power supply shut off means, and this circuit board also contains various logic circuits. Further, in the example of the present preferred embodiment of the present invention, although a concrete example of two CPUs is described for two or more CPUs, the spirit and intent of the present invention shall not be construed to be limited to the present concrete example.

Also, 111 is one of the two or more CPUs (hereinafter referred to as ENG_CPU) that functions as the control means that carries out the heat source temperature control of a single fixing unit or the temperature abnormality detection control using a single power supply shut off means. 112 is the other of the two or more CPUs (hereinafter referred to as SUB_CPU.) that functions as the control means that carries out the heat source temperature control of a single fixing unit or the temperature abnormality detection control using a single power supply shut off means.

Further, ENG_CPU 111 and SUB_CPU 112 are carrying out transmission of data by serial communication. Further, SYS_CPU 101 and ENG_CPU 111 also carry out data transmission by serial communication.

In addition, in the present preferred embodiment of this invention, the order of priority is established so that ENG_CPU 111 is the higher level CPU (hereinafter referred to simply as the higher level CPU) and SUB_CPU 112 is the lower level CPU (hereinafter referred to simply as the lower level CPU). Further, SYS_CPU 101 has been stipulated as the highest level CPU (hereinafter referred to as the highest level CPU) that controls said two or more CPUs. Because of this, each of said CPUs is connected to the others by communication links with the higher level CPU monitoring the lower level CPU at regular intervals of time, and when any abnormality occurs in a lower level CPU, all the control rights possessed by the CPU that has an abnormality will be transferred to the higher level CPU in this configuration.

Also, 113 is an A/D converter that converts the temperature detection result from the sensor to be described later into digital data. The digital data of the temperature detection result generated by this A/D converter is supplied to ENG_CPU 111 and SUB_CPU 112.

114 is the logic circuit that receives the control output (temperature abnormality detection control) from ENG_CPU 111 and SUB_CPU 112 and drives the relay to be described later. Further, 115 is an inverter that inverts the control output from SUB_CPU 112 and supplies that inverted output to the logic circuit 114.

116 is the logic circuit that receives the control output from ENG_CPU 111 and SUB_CPU 112 and drives the heater to be described later. Further, 117 is an inverter that inverts the output of the logic circuit 116.

120 is a relay that functions as a power supply shutting off means that shuts off the power supply to said heat source based on the temperature abnormality detection control from ENG_CPU 111 and SUB_CPU 112. Further, this relay 120 supplies to the heater to be described later the 100V AC power supply from the commercial electric power supply.

130 is a heater that functions as a heat source and generates heat from the electric power supply. Further, this heater 130 is subjected to the heat source temperature control from ENG_CPU 111 and SUB_CPU 112, and is controlled so that the temperature is maintained at a specific value. 140 is the temperature sensor that detects the temperature of the heater 130 which is the heat source, and the result of temperature detection by this sensor is supplied to the A/D converter 113 and is then supplied for use in the heat source temperature control.

In the following, the examples of control (1) to (7) that are characteristic of the image forming apparatus in the present preferred embodiment of this invention.

(1) Two or more CPUs are used as the control means and the heat source temperature control of a single fixing unit or the temperature abnormality detection control using a single power supply shutting off means is carried out. As a result of this, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

(2) A priority order is assigned to the heat source temperature control of the control means configured using two or more CPUs, the heat source temperature control and the temperature abnormality detection control are carried out by the CPU with the higher order of priority, the temperature abnormality detection control is carried out by the CPU with the lower order of priority, and the priority level of temperature abnormality detection control is the same for both the higher level CPU and the lower level CPU, and when one CPU has become abnormal the other CPU becomes effective in controlling said power supply shutting off means. As a consequence of this, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

(3) This is an image forming apparatus with the feature that two or more CPUs are used as the control means for carrying out the heat source temperature control of a single fixing unit or the temperature abnormality detection control using a single power supply shutting off means, a priority order is assigned to the heat source temperature controls of the two or more CPUs configuring the control means, the CPU with the higher level of priority and the CPU with the lower levels of priority can all carry out heat source temperature control and temperature abnormality detection control, and at the time the power supply to the apparatus is switched on, the CPU with the lower order of priority carries out the heat source temperature control irrespective of the status of the heat source. As a result of this, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it. In addition, since the CPU with the lower level of priority is carrying out the heat source temperature control at the time the power supply to the apparatus is switched on, it is possible to carry out appropriately and quickly the temperature control of the heat source at the time the power supply to the image forming apparatus is switched on.

(4) This is an image forming apparatus with the feature that two or more CPUs are used as the control means for carrying out the heat source temperature control of a single fixing unit or the temperature abnormality detection control using a single power supply shutting off means, a priority order is assigned to the heat source temperature controls of the two or more CPUs configuring the control means, the CPU with the higher level of priority and the CPU with the lower levels of priority can all carry out heat source temperature control and temperature abnormality detection control, and during the period of time until a specific interval of time has elapsed after the time the power supply to the apparatus is switched on or until the heat source reaches a specific temperature, whichever is reached earlier, the CPU with the lower priority level carries out the heat source temperature control irrespective of the status of the heat source. As a result, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it. In addition, since the CPU with the lower level of priority is carrying out the heat source temperature control at the time the power supply to the apparatus is switched on, it is possible to carry out appropriately and quickly the temperature control of the heat source at the time the power supply to the image forming apparatus is switched on, in the case when the different processing tasks of starting the image forming apparatus are being handled by the CPU with the higher level of priority.

(5) This is an image forming apparatus having the feature that it has as its control means that carries out using two or more CPUs the heat source temperature control of a single fixing unit or the temperature abnormality detection control using a single power supply shut off means, and a CPU with the highest level of priority is provided that is capable of resetting any of said two or more CPUs or of shutting off the power supply to them, and said highest priority level CPU resets or shuts off the power supply to any of said two or more CPUs when a temperature abnormality is detected. As a result, since not only the task of heat source temperature control is shared by plural CPUs but also since the plural CPUs are being controlled by the highest level CPU, the reliability is increased. Because of this, it is possible to carry out appropriate control of the temperature of the heat source without having to use a dedicated hardware circuit for shutting off the power supply to the heat source when there is a temperature abnormality in it.

(6) This is an image forming apparatus having the feature that it comprises a display section 103, and when a temperature abnormality is detected, not only that the highest level CPU either shuts off the power supply to or resets any of said two or more CPUs but also the fact that a temperature abnormality has occurred is displayed on said display section 103. As a result of this feature, since the task of heat source temperature control is shared by plural CPUs, the reliability is increased, it is possible to carry out appropriate control of the temperature of the heat source without having to use a dedicated hardware circuit for shutting off the power supply to the heat source when there is a temperature abnormality in it, and also it becomes possible for the operator to grasp the occurrence of that state easily.

(7) This is an image forming apparatus having the feature that it comprises as its control means two or more CPUs for which orders of priorities have been assigned, and a CPU with the highest level of priority is provided that controls said two or more CPUs, each of said CPUs is connected by communication links, the higher level side CPU monitors at regular intervals of time the lower level CPUs and, when any abnormality occurs in a lower level CPU, the control rights possessed by the lower level CPU that has developed an abnormality are immediately transferred to the higher level CPU. As a result of this, since the task of heat source temperature control is shared by plural CPUs, the reliability is increased, and since a CPU that has developed some abnormality can be reset or its power supply shut off and also the controls being carried out until then by the CPU that has developed an abnormality are handled by a higher level CPU, it is possible to carry out appropriate control of the temperature of the heat source without having to use a dedicated hardware circuit for shutting off the power supply to the heat source when there is a temperature abnormality in it, and also it becomes possible to recover quickly the CPU that has developed an abnormality.

In the following, an example of operation of the present preferred embodiment of the present invention is described below. Further, the operation in the example of the present preferred embodiment is described separately for different controls, in the sequence of heat source temperature control, temperature abnormality detection control, and CPU abnormality control.

(Heat Source Temperature Control)

Here, the control means is configured using two or more CPUs with said control means carrying out heat source temperature control of a single fixing unit. Also, in the following, "Heat source temperature control" is the control of switching on and off the heater 130 so that the heat source temperature is maintained at a specific temperature necessary for fixing the formed image.

Figures 2, 3:
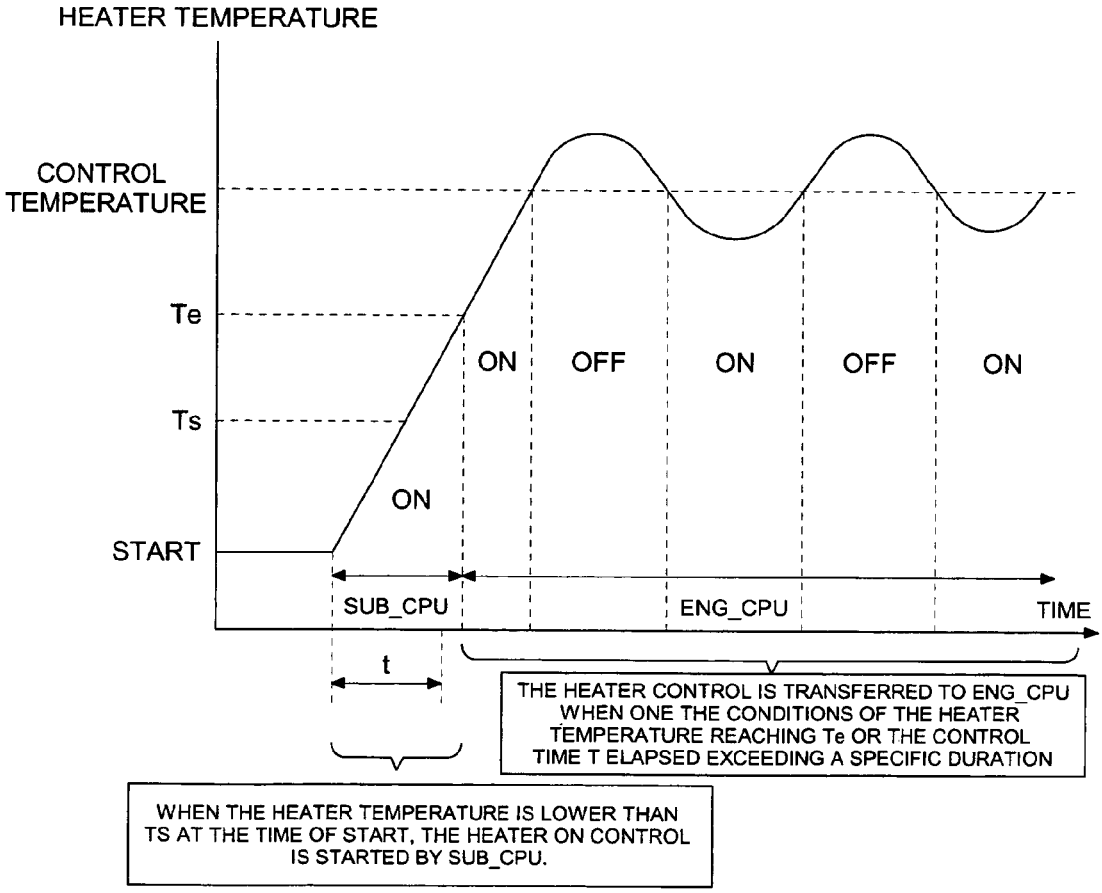
FIG. 2 is a block diagram showing the configuration of the main parts of the image forming apparatus according to the first preferred embodiment of the present invention.
FIG. 3 is a circuit configuration diagram showing an example of the heater connection conditions in a heater control device according to the first preferred embodiment of the present invention.

The heater will be off at the time the power supply is switched on to the image forming apparatus, as is shown in (1) in FIG. 2(*a*). Further, similarly, as shown in (2) of FIG. 2(*b*), even the relay 120 will be in the OFF state at the time the power supply to the image forming apparatus is switched on.

Further, SUB_CPU 112 detects the temperature of the heater 130 after it completes its own initialization operations, and if the temperature is confirmed to be less that the set temperature Ts, it passes current through the heater 130 [the heater is made ON in FIG. 2(*a*) and the relay is made ON in FIG. 2(*b*)].

When one of the conditions of the temperature Te of the heater 130 reaching the set temperature Ts (Te>Ts) or the time of control reaches t seconds, SUB_CPU 112 hands over the control task to ENG_CPU 111.

Hence, either after the temperature Te has reached the set temperature or after a control time of t seconds has elapsed, ENG_CPU 111 carries out the heat source temperature control (the part of repeating ON and OFF in FIG. 3). Further, in this case, in FIG. 2, signal B of SUB_CPU 112 is kept fixed at the 1 level and the control of the supply of current to the heater 130 can be carried out by toggling the level of the signal A of ENG_CPU 111 between 0 and 1.

In this manner, it is possible for a lower priority level CPU and a higher priority level CPU both to carry out heat source temperature control, and because the lower priority level CPU carries out the heat source temperature control irrespective of the status of the heater at the time the power supply to the apparatus is switched on, in the case when the various initialization operations at the time of starting up the image forming apparatus is being handled by the higher priority level CPU, it will be possible to carry out appropriately and speedily the temperature control of the heat source even at the time of starting up the image forming apparatus.

In other words, compared to the conventional apparatus in which the control was being carried out by a single CPU, it is possible to reduce the warm-up duration because the various initialization and other operations as well as the heat source temperature control can be executed in parallel at the time of starting up the apparatus.

(Temperature Abnormality Detection Control)

Here, "temperature abnormality detection control" is the control of detecting whether the temperature has become an abnormal temperature, that is, the temperature has fallen outside a specific range near the specific temperature necessary for fixing in image formation, and in that case speedily shutting off the power supply to the heater 130.

Here, two or more CPUs (ENG_CPU 111 and SUB_CPU 112) are used as the control means carry out the heat source temperature control of a single fixing unit (the heater 130) or the temperature abnormality detection control using a single power supply shutting off means (the relay 120), the two or more CPUs configuring the control means are assigned priority orders, and the configuration is such that both the CPU with the higher level of priority (ENG_CPU 111) and the CPU with the lower level of priority (SUB_CPU 112) can carry out heat source temperature control and temperature abnormality detection control.

In other words, the temperature abnormality detection control is carried out by putting the relay 120 in the OFF state (see FIG. 2) when either one of ENG_CPU 111 and SUB_CPU 112 detects an abnormal temperature of the heater 130 from the result of detection sent by the sensor 140.

In the case of this temperature abnormality detection control, since the relay 120 will be in the ON state only when the signals C and D in FIG. 2(*b*) are in the "1" state but the relay will be in the OFF state in all other states, even when either one of the CPUs goes into an abnormal state, the relay 120 goes into the OFF state without any problems and hence it is possible to shut off the power supply to the heater 130 in this case.

As a result of this, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it.

Further, this image forming apparatus has the feature that it comprises a control means that carries out using two or more CPUs (ENG_CPU 111 and SUB_CPU 112) the heat source temperature control of a single fixing unit (heater 130) or the temperature abnormality detection control using a single power supply shut off means (relay 120), and a CPU with the highest level of priority (SYS_CPU 101) is provided that is capable of resetting said two or more CPUs or of shutting off the power supply to them, and said highest priority level CPU (SYS_CPU 101) resets or shuts off the power supply to the two or more CPUs when a temperature abnormality is detected.

Here, SYS_CPU 101 can stop the power supply to ENG_CPU 111 and SUB_CPU 112 by sending an instruction to DCPS 104. In addition, it is also possible for SYS_CPU 101 to reset ENG_CPU 111 or SUB_CPU 112 by applying a control signal to the respective reset pins not shown in the figure.

As a result, since not only the task of heat source temperature control is shared by plural CPUs but also the plural CPUs are being controlled by the highest priority level CPU the reliability is increased. Because of this, it is possible to carry out appropriate control of the temperature of the heater 130 without having to use a dedicated hardware circuit for shutting off the power supply when there is a temperature abnormality in the heater 130.

Further, when SYS_CPU 101 having the highest priority level detects a temperature abnormality, in addition to carrying out either resetting or shutting off the power supply of said two or more CPUs it is also desirable that the fact that a temperature abnormality has occurred is displayed in the display section. Because of this, it is possible to carry out appropriate control of the temperature of the heater 130 without having to use a dedicated hardware circuit for shutting off the power supply when there is a temperature abnormality in the heater 130 and it becomes easy for the operator to grasp that such a condition has occurred.

(CPU Abnormality Control)

Next, the control in the event of a CPU operation abnormality in the image forming apparatus is described here. Here, "CPU abnormality control" is the control of detecting a CPU that is not operating normally, either shutting off the power supply to or resetting that CPU, or transferring the rights of all the controls being executed by until then by the CPU that has generated and abnormality to some other CPU.

Here, two or more CPUs (ENG_CPU 111 and SUB_CPU 112) for which the order of priority has been assigned and a highest priority level CPU (SYS_CPU 101) that controls said two or more CPUs is provided as said control means, each of said CPUs is connected to each other by serial communication links, the higher level CPU monitors the lower level CPUs at regular intervals of time, and when any abnormality occurs in a lower level CPU, the control rights possessed by the lower level CPU that has generated some abnormality are transferred to a higher level CPU in this configuration.

In concrete terms, the highest priority level CPU issues commands at regular intervals of time to the higher level CPU and the lower level CPU and verifies the response to those commands thereby polling the operating status of the other CPUs.

When an operation abnormality is detected such as when the response from the lower level CPU cannot be confirmed, immediately the fixing control rights possessed by the CPU that has developed an operation abnormality are transferred to the CPU at a level immediately above it, and the CPU that has developed an operation abnormality is made to recover to normal operation either by shutting off its power supply or by resetting it.

As a result of this, since the CPU that has developed an operation abnormality is reset, etc., and also the controls that were being executed by that CPU with operation abnormality are handled by a higher level CPU, it is possible to carry out appropriate control of the temperature of the heater 130 without having to use a dedicated hardware circuit for shutting off the power supply when there is a temperature abnormality in the heater 130, and also it becomes possible to speedily recover the CPU with the operation abnormality.

Further, by displaying the fact that the CPU is in that state in the display section of the higher level CPU, it is possible to carry out appropriate control of the temperature of the heater 130 without having to use a dedicated hardware circuit for shutting off the power supply when there is a temperature abnormality in the heater 130, and also it becomes possible for the operator to grasp the condition easily.

As has been explained so far, according to the present invention, since the task of heat source temperature control is shared by plural CPUs, the reliability is increased, and it is possible to carry out appropriate control of the temperature of the heat source without having to use a dedicated hardware circuit for shutting off the power supply to the heat source when there is a temperature abnormality in it. In addition, according to the present invention, it is possible to carry out appropriately and quickly the temperature control of the heat source even at the time the power supply to the image forming apparatus is switched on.

What is claimed is:

1. An image forming apparatus, comprising:

a fixing device including a heat source to receive power and to generate heat, and a temperature sensor to detect a temperature of the heat source;

a control section to conduct a heat source temperature control and an abnormal temperature detecting control in response to a detection result of the temperature sensor; and an electric power cutoff section to cut off supply of the power to the heat source in accordance with the abnormal temperature detecting control by the control section;

wherein the control section conducts at least one of the heat source temperature control for the fixing device and the abnormal temperature detecting control for the electric power cutoff section with at least two CPUs having respective priority orders;

wherein the at least two CPUs are connected to each other so as to be capable of communication with each other; and wherein a higher-positioned CPU, which has a higher priority order, monitors a lower-positioned CPU, which has a lower priority order, and when an abnormality occurs at the lower-positioned CPU, the higher-positioned CPU obtains a control right of the lower-positioned CPU.

2. The image forming apparatus of claim 1, wherein the higher-positioned CPU conducts the heat source temperature control and the abnormal temperature detecting control and the lower-positioned CPU conducts the abnormal temperature detecting control.

3. The image forming apparatus of claim 2, wherein the higher-positioned CPU and the lower-positioned CPU have a same level priority for the abnormal temperature detecting control.

4. The image forming apparatus of claim 1, wherein the higher-positioned CPU is able to conduct the heat source temperature control and the abnormal temperature detecting control, and wherein when a power source for the apparatus is switched ON, the lower-positioned CPU conducts the heat source temperature control regardless of a condition of the heat source.

5. The image forming apparatus of claim 1, wherein the higher-positioned CPU is able to conduct the heat source temperature control and the abnormal temperature detecting control, and wherein until one of: (i) a predetermined time elapses after a power source for the apparatus is switched ON, and (ii) the temperature of the heat source becomes a predetermined temperature after the power source for the apparatus is switched ON, the lower-positioned CPU conducts the heat source temperature control regardless of a condition of the heat source.

6. The image forming apparatus of claim 1, wherein the control section includes a highest-positioned CPU which has a highest priority order and is able to control the at least two CPUs to at least one of: cut off supply of the power and reset the at least two CPUs, and wherein when an abnormal temperature is detected, the highest-positioned CPU one of: cuts off supply of the power and resets the at least two CPUs.

7. The image forming apparatus of claim 6, further comprising:

a display section to indicate a condition of the apparatus;

wherein when an abnormal temperature is detected, the highest-positioned CPU controls the display section to indicate the occurrence of the abnormal temperature.

8. The image forming apparatus of claim 1, wherein the control section comprises the at least two CPUs, which are provided with respective priority orders, and a highest-positioned CPU which has a highest priority order and controls the at least two CPUs, wherein the at least two CPUs and the highest-positioned CPU are connected with each other with communications.

9. An image forming apparatus, comprising:

a fixing device including a heat source to receive power and to generate heat, and a temperature sensor to detect a temperature of the heat source; and a control section which includes at least two CPUs having respective priority orders, and which conducts a heat source temperature control and an abnormal temperature detecting control for the fixing device with the at least two CPUs in response to a detection result of the temperature sensor;

wherein the at least two CPUs are connected to each other so as to be capable of communication with each other; and wherein a higher-positioned CPU, which has a higher priority order, monitors a lower-positioned CPU, which has a lower priority order, and when an abnormality occurs at the lower-positioned CPU, the higher-positioned CPU obtains a control right of the lower-positioned CPU.

10. The image forming apparatus of claim 9, further comprising:

an electric power cutoff section to cut off supply of the power to the heat source in accordance with the abnormal temperature detecting control by the control section.

* * * * *